United States Patent [19]

Swisher

[11] Patent Number: 4,492,100

[45] **Date of Patent: * Jan. 8, 1985**

[54] KEY FOR A LOCK OF THE PLUNGER OPERATED TYPE

[76] Inventor: James A. Swisher, 2497 Castellon Drive North, Jacksonville, Fla. 32217

[ * ] Notice: The portion of the term of this patent subsequent to Jan. 24, 2001 has been disclaimed.

[21] Appl. No.: 281,704

[22] Filed: Jul. 9, 1981

[51] Int. Cl.[3] ..... E05B 19/18; E05B 35/06

[52] U.S. Cl. ..... 70/34; 70/386; 70/395; 70/411; 70/412

[58] Field of Search ..... 70/32-34, 70/386, 395, 408, 411, 412; 24/211 N

[56] References Cited

U.S. PATENT DOCUMENTS

| | | | |
|---|---|---|---|
| 3,033,016 | 5/1962 | Moberg | 70/34 |
| 3,330,141 | 7/1967 | Greenwald | 70/411 |
| 3,446,045 | 5/1969 | Finck | 70/34 |
| 3,478,548 | 11/1969 | Finck | 70/34 |
| 3,727,440 | 4/1973 | Greenwald et al. | 70/411 |
| 4,058,992 | 11/1977 | Nielsen | 70/34 |
| 4,252,006 | 2/1981 | Swisher | 70/34 |
| 4,313,319 | 2/1982 | Haus et al. | 70/34 |

*Primary Examiner*—Robert L. Wolfe

*Assistant Examiner*—Lloyd A. Gall

*Attorney, Agent, or Firm*—Robert E. Ross

[57] ABSTRACT

A key for a lock of the plunger operated type in which an elongated housing has an internal axially movable plunger which releases locking elements when moved toward the open end of the housing, said key having a body with elongated fingers forwardly from the housing and an elongated mandrel disposed between the fingers. A spacer is disposed at the rear end of the fingers and protrudes forwardly from the foremost face of the key housing for abutting a portion of the lock to limit the distance the fingers can extend into the lock. The housing has a head portion which is axially adjustable in relation to the spacer to vary the amount the spacer projects forwardly from the housing.

In one embodiment of the invention internal structure is provided that allows the fingers to shift forwardly a predetermined distance if the forward end of the housing is removed by grinding in an effort to modify the key for use in locks with which it is not intended for use. Such forward movement causes the fingers to spread on the mandrel, rendering the key inoperative for use in any lock.

6 Claims, 7 Drawing Figures

KEY FOR A LOCK OF THE PLUNGER OPERATED TYPE

BACKGROUND OF THE INVENTION

In the utility industry, locks of the plunger operated type are often used to protect meters, meter boxes and valves that control the supply of electricity or gas. A suitable "key" or operating tool is provided to service personnel to enable them to open the locks as required. However these keys are often lost or stolen, and over a period of time many of these keys find their way into the hands of unauthorized personnel, who use them to remove and reverse meters, or to short across meter terminals, or to open valves that have been locked closed for nonpayment of utility bills.

Also, utilities that have adjoining territories prefer to have locks and keys that are not interchangeable, so that keys lost by service personnel of one utility cannot be used to open the locks of the adjoining utility.

Various efforts have been made to provide locks that can be opened only with a special key, and keys that cannot be modified to open other locks. For example, in my U.S. Pat. No. 4,252,006 there is illustrated a plunger lock and key in which the engaging means between the fingers of the key and the lock plunger have a configuration such that "generations" of locks and keys may be provided, so that a later "generation" key will open earlier "generation" locks, but will not open later generation locks. However in some cases the keys can be modified bv unauthorized persons to open later generation locks.

In my copending U.S. application Ser. No. 281,701, filed July 9, 1981, there is illustrated a lock and key combination which provides an improved system of locks and keys of various levels, which utilizes a key as disclosed and claimed in this application.

SUMMARY OF THE INVENTION

This invention provides a key for use with a lock of the plunger operated type, in which the key structure provides adjustment means to enable the key to open locks of the same or a lower level, yet prevents modification thereof to operate locks which the key is not intended to open. It has been found that some types of key may be modified to open locks not intended for operation by the key by grinding off some of the face of the lock, so that the lock operating fingers are capable of reaching further into a lock. However, if the forward face of the present lock disclosed herein is ground off, the finger carrier is allowed to move forward a predetermined distance in relation to the mandrel, thereby spreading the fingers at their ends, so that they cannot be inserted into a lock of any type. To provide a key which is capable of opening locks of its own and lower "levels", an adjusting cap is provided on the front end of the housing, which is adjustable axially in relation to the lock operating fingers, to enable the key to open locks of the same or a lower level, yet prevents modification thereof to operate locks which the key is not intended to open.

DESCRIPTION OF THE ILLUSTRATED EMBODIMENT

Figure 2:
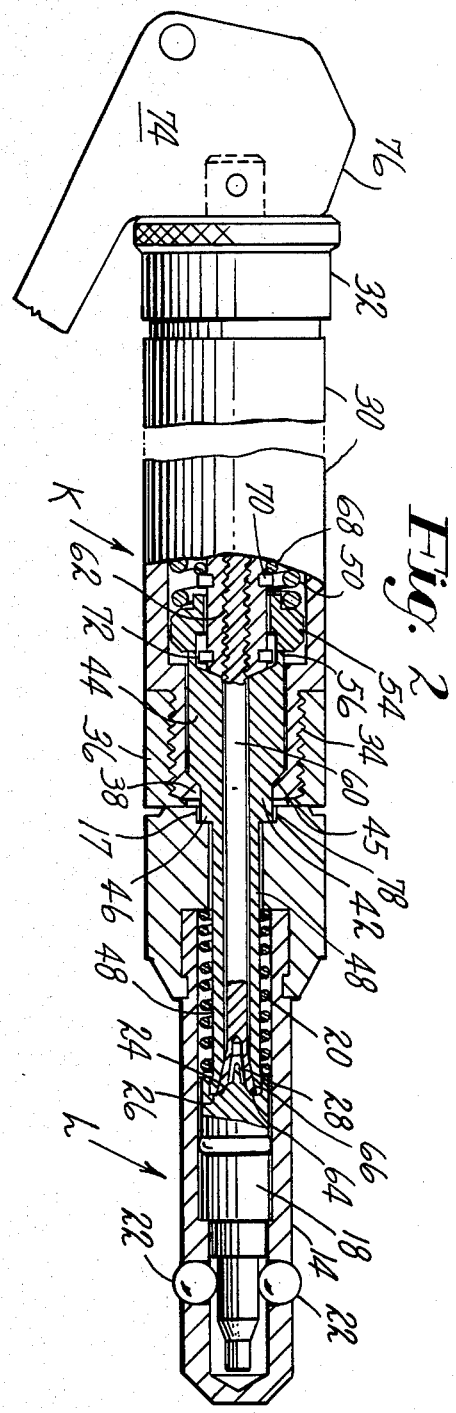
FIG. 2 is a view of the key of FIG. 1 assembled with a lock designed for use with the key.

Referring to the drawing, there is illustrated a key K for opening a lock L of the plunger operated type, said lock comprising a housing 14 having an internal cavity 16 opening to one end 17, and a plunger 18 axially movable in the cavity. The plunger is spring biased away from the open end by a spring 20 so that it retains locking balls 22 in the extended locking position in which they project from the housing surface. Movement of the plunger toward the open end 17 a predetermined distance (usually far enough to fully compress the spring 20) allows the balls to move into the housing to the unlocking position.

Locks as described above are well known in the art. Certain aspects of the lock and key combination illustrated herein are disclosed and claimed in my co-pending U.S application Ser. No. 281,701, filed July 9, 1981 and other aspects thereof are disclosed and claimed in my U.S. Pat. No. 4,252,006 issued Feb. 24, 1981. As disclosed in said patent, the face 24 of the plunger is provided with a circumferential recess 26 and a projecting center post 28 for cooperation with the key in the manner described therein.

Figure 1:
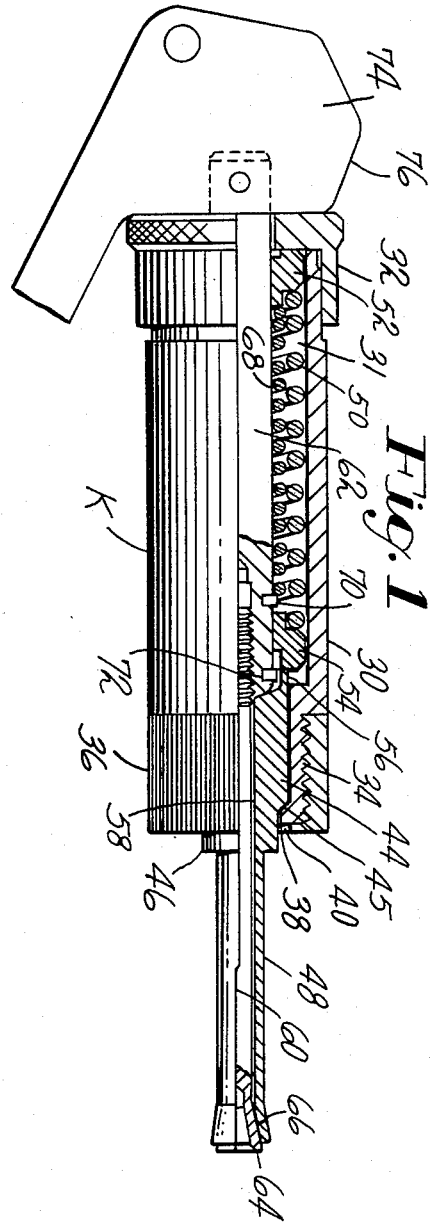
FIG. 1 is a view in elevation partly in section, of a key embodying the features of the invention.

The key K of the present invention comprises a hollow housing 30 having a retaining cap 32 closing the rear end and a front end portion 34 of reduced size which is externally threaded and receives an internally threaded adjusting head 36. The forward end of the front end portion 34 is provided with an inturned flange 38, and the adjusting head 36 has a central aperture 40 receiving the forward end of the portion 34. When the adjusting head is in the fully retracted position, as illustrated in FIG. 1, the front face of the adjusting head and the front face of the front end portion 34 of the housing are flush with each other. The forward end portion and the inturned flange 38 of the front end of the housing has an opening 42 leading to the housing cavity 31. Retained in the opening 42 is a finger carrier 44, which has a spacer 46 on the forward end which projects forwardly out of the housing.

Extending from the spacer 46 is a group of resilient fingers 48. The finger carrier 44 is biased to a forward position so that the forward end 45 thereof bears against the flange 38 by a spring 50 which is compressed between the retaining cap 32 and a forward bushing 54. The forward bushing 54 bears against a stop member 56 which projects rearwardly from the finger carrier, so that the forward bushing 54 is normally spaced from the rear end 35 of the front portion 34 of the housing for a purpose to appear hereinafter.

Disposed within a central opening 58 in the finger carrier is a mandrel 60 which projects forwardly from a support rod 62 through the finger carrier to extend into the space between the resilient fingers 48, and terminates in an enlarged head 64 which has an inclined outer surface 66 against which ends 49 of the fingers 48 rest.

The mandrel 60 and mandrel support rod 62 are biased forwardly by a second spring 68 disposed between the retaining cap 32 and a retaining ring 70 mounted on the mandrel support rod 62. A second retaining ring 72 is mounted on the mandrel support rod forwardly of the forward bushing 54 for a purpose to appear hereinafter.

The mandrel support rod 62 extends through the retaining cap 32 and an operating lever 74 is mounted on the end of said rod, said lever having a cam surface 76 so shaped and positioned that pivoting of the lever 74 moves the mandrel support rod 62 and mandrel 60 rearwardly, with retaining ring 70 compressing spring 68, so as to draw the mandrel head 64 into the fingers 48.

When the lever 74 is operated without the fingers 48 being inserted into a lock or other structure that confines the ends of the fingers so as to limit their radial expansion, after the mandrel has moved rearwardly a predetermined distance, the forward retaining ring 72 on the mandrel support rod 62 engages the forward bushing 54. Thereafter rearward movement of the mandrel support rod moves the bushing 54 rearwardly and the friction between the enlarged head 64 of the mandrel and the surrounding fingers 48 also causes the fingers and the finger carrier to also move rearwardly. The above described structure prevents damage to the fingers by restricting the distance the enlarged head can be drawn into the fingers when the lever 74 is operated without the fingers being inserted into a lock.

Figure 3:
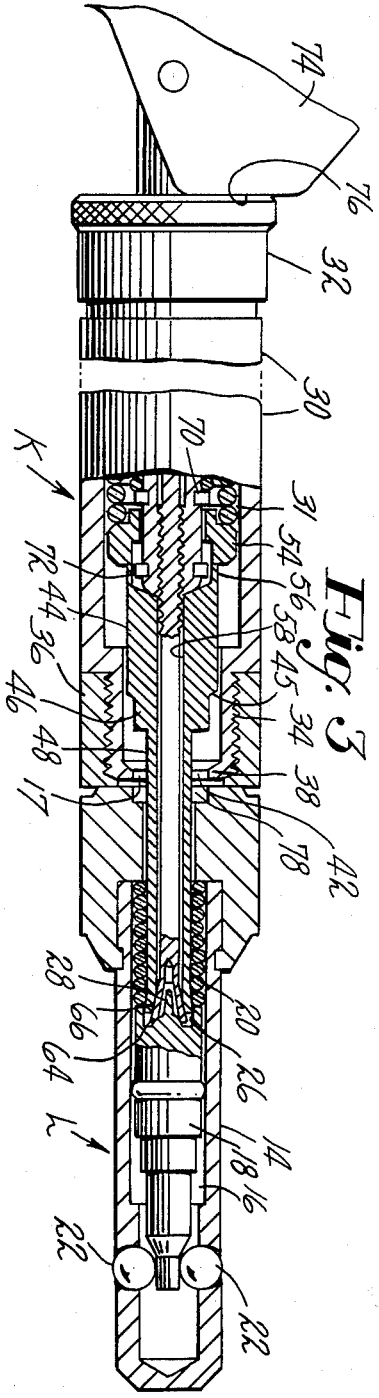
FIG. 3 is a view of the assembly of FIG. 2 in which the key has been operated to pull the plunger to the unlocking position.
Figure 6:
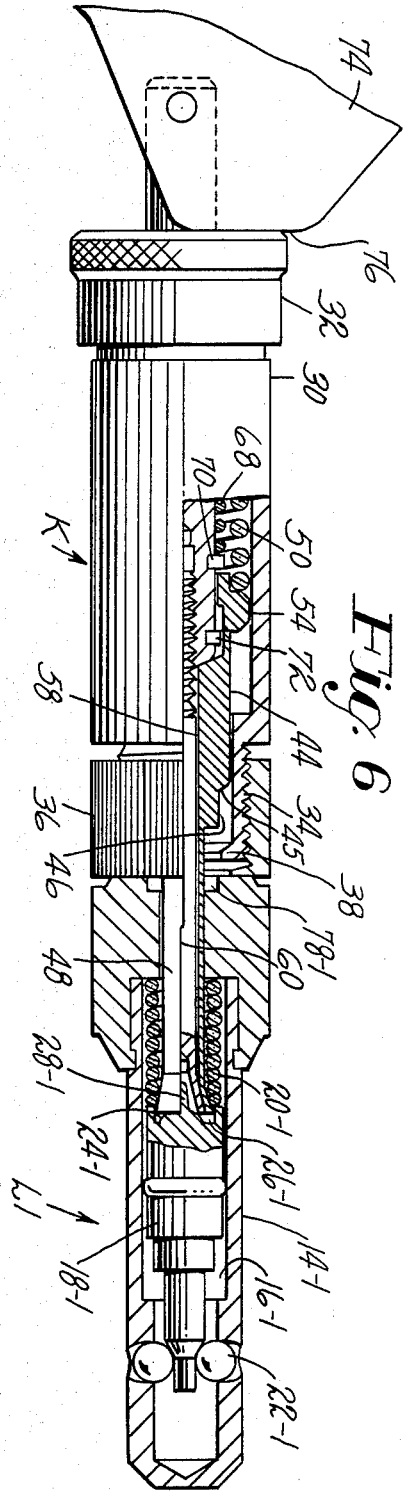
FIG. 6 is a view of the assembly of FIG. 4 in which the key has pulled the plunger of the lock after the head of the key has been adjusted to a position against the head of the lock.

As illustrated in FIGS. 2 and 3, when the key 10 is inserted into a lock 12 of proper dimensions, the spacer 46 seats in a suitable recess 78 in the rear face of the lock housing, and the forward end of the mandrel is positioned against the face of the plunger 18. Operation of the lever 74 causes the mandrel to retract within the fingers 48, spreading the ends thereof outwardly into engagement with the walls of the recess 26. When the finger ends bear against the recess wall, further movement of the mandrel in relation to the fingers ceases, and further movement of the lever 74 cause the fingers to move with the operative lever, drawing the plunger 18 as illustrated in FIG. 3, the lock spring 20 must be fully compressed to "solid height" to allow the plunger to reach the unlocking position, which requires the maximum possible travel of the mandrel toward the unlocking position.

As described in the above identified co-pending application, the adjusting head 36 enables the key to be used to open locks of a lower "level", that is, with a shallower recess in the head.

Figure 4:
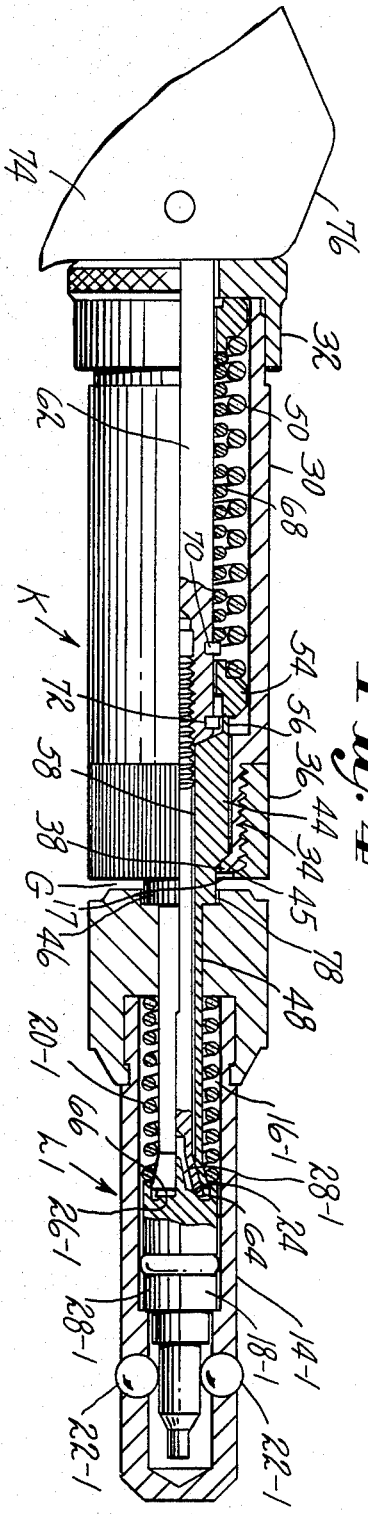
FIG. 4 is a view of the key of FIG. 1 assembled into a lock of a lower "level" than the key.

For example, referring to FIG. 4, there is illustrated the key of FIG. 1 inserted into a lock L1 in which the bottom of the recess 78-1 and the plunger face 24 are closer to the open end of the lock than is the case in the lock L. On insertion of the key K into the lock L1 when the forward end of the spacer 46 bottoms in recess 78-1, although the fingers 48 are positioned to engage the plunger when the lever 74 is operated, the key cannot open the lock because of the gap G between the lock and key.

As the lever 74 is operated, the first increment of the motion of the mandrel is relative to the fingers to cause them to spread into engagement with the plunger recess. The next increment of mandrel motion does not draw the plunger toward the open end of the lock housing, but instead draws the key body and the lock body together to close the gap G as the spacer 46 retracts into the front of the key housing. Only after this gap is closed, so that the front face of the key abuts the head of the lock, does continued movement of the mandrel and fingers cause the plunger to be pulled toward the unlocking position.

However, as stated above, the plunger must move far enough to fully compress the spring 20 to reach the unlocking position, and since some of the available travel of the mandrel must be utilized to draw the lock and key together, there is not sufficient residual mandrel travel available to pull this plunger to the unlocking position.

Figure 5:
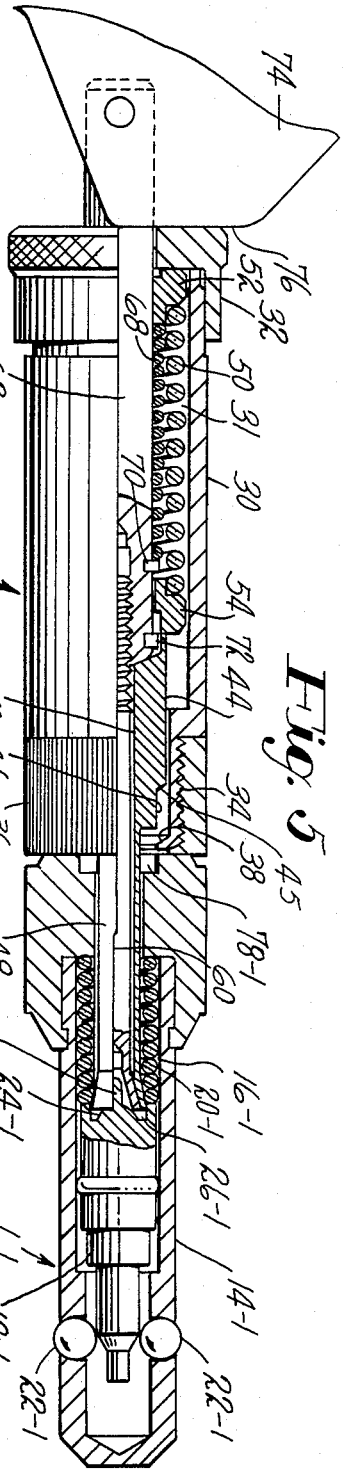
FIG. 5 is a view of the assembly of FIG. 4 in which the key has pulled the plunger of the lock as far as possible.

The adjustable head 36, which is movable axially independently of the spacer, can be utilized to allow the key K to open lock L1, by rotating the head to cause it to move forwardly in relation to the spacer, until the forward face of the adjusting head abuts the face of the lock head (see FIG. 5). Thereafter, operation of the lever 74 can cause sufficient motion of the plunger to draw it to the unlocking position, since none of the motion is used to draw the lock and key together.

Figure 7:
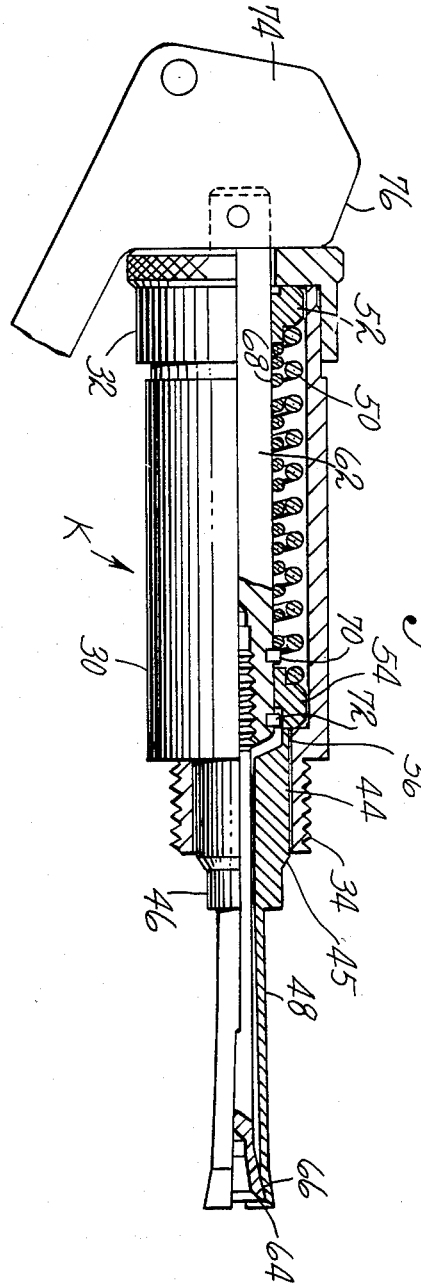
FIG. 7 is a view of the key of FIG. 1 after a portion of the front end of the housing has been ground off.

Some locks used in the utility industry have the plunger recessed more deeply in the housing than others, to be opened by a key with fingers of suitable length. To modify a key with shorter finger length to open a lock with a plunger face further into the lock than the key can reach, interlopers will often grind off the front face of the key housing to increase the effective length of the fingers. However, if the front end of the housing 30 of the key K disclosed herein is ground off (after removing the adjusting head 36) as illustrated in FIG. 7, to an extent such that the flange 38 is removed, the spring 50 will force the bushing 54 and the finger carrier 44 forwardly until the bushing encounters the inner wall 35 of the front portion of the housing. The forward movement of the finger carrier will cause the fingers 48 to move forwardly in relation to the mandrel, spreading the ends of the fingers on the mandrel head 64, so that the overall diameter of the finger ends is too great to allow insertion into a lock.

Since certain changes apparent to the skilled in the art can be made in the herein illustrated embodiment of the invention, it is intended that all matter contained herein be interpreted in an illustrative and not a limiting sense.

I claim:

1. In a key for opening a lock of the plunger operated type, said key comprising a housing, a series of resilient fingers extending forwardly from a finger carrier axially movable in the housing, and a mandrel disposed between the fingers which is retractable through the finger carrier to spread the fingers, the improvement comprising adjustable means on the key for varying the effective length of the fingers.

2. A key as set out in claim 1 in which said means for varying the effective length of the fingers comprises a cap threadedly received on the forward end of the housing.

3. A key as set out in claim 2 in which a spacer is provided in on the forward end of the finger carrier, said spacer projecting forwardly through the cap, whereby rotation of the cap moves the cap axially on the housing to vary the effective length of the spacer.

4. In a key for opening a lock of the plunger operated type, said key including a housing, a finger carrier axially movable in the housing, a series of resilient fingers extending forwardly from the housing and means for first spreading the ends of said fingers and then retracting the fingers, the improvement comprising a spacer disposed on the finger carrier at the base of the fingers, said spacer projecting forwardly from the front of the housing.

5. A key as set out in claim 4 in which the forward end of the housing is closed by an axially adjustable cap having a central aperture, and said spacer extends through said aperture.

6. In a key for opening a lock of the plunger operated type, said key including a housing, an axially movable finger carrier in the housing and a series of resilient fingers extending forwardly from the housing, with a central mandrel movable rearwardly to spread the ends of the fingers and means biasing said finger carrier forwardly, the improvement comprising a relatively thin inturned flange at the forward end of the housing forming a central aperture, said flange retaining the finger carrier in the housing against the biasing force so that removal of the flange allows the finger carrier to move forwardly in relation to the mandrel, in which means is provided in the housing for limiting the forward movement of the biasing means when the flange is removed, so as to thereby limit the forward movement of the fingers in relation to the mandrel when the flange is removed, said biasing force being provided by a spring and a bushing disposed between the finger carrier and the spring, said limiting means comprising a bushing stop menber provided on the housing, and the finger carrier normally maintains the bushing in spaced relation to the stop member.

* * * * *